US006619984B2

(12) United States Patent
Liu

(10) Patent No.: US 6,619,984 B2
(45) Date of Patent: Sep. 16, 2003

(54) ELECTRICAL CONNECTOR HAVING IMPROVED SHIELDING

(75) Inventor: Jun Xian Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/116,389

(22) Filed: Apr. 3, 2002

(65) Prior Publication Data

US 2003/0119354 A1 Jun. 26, 2003

(30) Foreign Application Priority Data

Dec. 26, 2001 (TW) ..... 90223022 U

(51) Int. Cl.[7] ..... H01R 13/648
(52) U.S. Cl. ..... 439/607
(58) Field of Search ..... 439/567, 607, 439/608, 609, 610

(56) References Cited

U.S. PATENT DOCUMENTS 6,099,351 A * 8/2000 Wu ..... 439/541.5
6,183,294 B1 * 2/2001 Fan et al. ..... 439/567
6,309,227 B1 * 10/2001 Chen et al. ..... 439/607
6,364,700 B1 * 4/2002 Zhu et al. ..... 439/567
6,375,498 B1 * 4/2002 Yu et al. ..... 439/567
6,398,587 B1 * 6/2002 Chen et al. ..... 439/573
6,416,359 B1 * 7/2002 Zhang et al. ..... 439/607
6,419,524 B1 * 7/2002 Ma ..... 439/607

* cited by examiner

*Primary Examiner*—Lynn Feild
*Assistant Examiner*—Thanh-Tam Le
(74) *Attorney, Agent, or Firm*—Wei Te Chung

(57) ABSTRACT

An electrical connector for mounting to a printed circuit board (PCB) includes a dielectric housing (3) having a mating portion (31) and a mounting portion (32), a plurality of terminals (4) received in the housing, and a shell (2) shielding the housing including a first shielding (21) surrounding the mating portion and a second shielding (22) engaging with the mounting portion. The second shielding is electrical connected with the first shielding and has an elongated shielding plate (221) attached to a front surface of the mounting portion and a pair of holding legs extending from two ends of the shielding plates, the holding legs (22*a*) respectively attaching to two side surfaces of the mounting portion and extending downwardly.

4 Claims, 3 Drawing Sheets

ELECTRICAL CONNECTOR HAVING IMPROVED SHIELDING

FIELD OF THE INVENTION

The present invention relates to an electrical connector, and more particularly to an electrical connector having an improved Electro Magnetic Interference (EMI) shielding.

BACKGROUND OF THE INVENTION

An electrical connector is often used for connecting a printed circuit board (PCB) with an electronic device for transmitting signals. A conventional connector generally includes a dielectric housing having a plurality of terminal-receiving cavities or passages, with a plurality of terminals received in the passages. A metal shield surrounds a substantial portion of the housing to protect at least the mating portions of the terminals from RF interference and Electro Magnetic Interference (EMI) as well as protecting the surroundings from interference radiating from the connector itself. The connector is mounted to the PCB, and the terminals have tail portions for connection, as by soldering, to circuit traces on the PCB. Such a connector often have hooks to hold the connector to the PCB, and such hooks have been provided by separate components, independent of the housing or the shield of the connector, to perform the function.

However, a problem of such structures is that the shield could not achieve a complete EMI shielding due to gaps between the shield and the PCB. Furthermore, these separate hooks cause problems in significantly increasing the fabrication and assembly costs of the connectors.

Hence, an electrical connector with an improved shielding is required to overcome the disadvantage of the prior art.

BRIEF SUMMARY OF THE INVENTION

A main object, therefore, of the present invention is to provide an electrical connector having an improved conductive shielding performing a complete Electro Magnetic Interference (EMI) shielding function.

Another object is to provide an electrical connector having a conductive shielding integrated with hooks to perform a multitude of functions by a one-piece structure.

An electrical connector according to the present invention for mounting to a printed circuit board (PCB) includes a dielectric housing having a mating portion and a mounting portion, a plurality of terminals received in the housing, and a shell shielding the housing including a first shielding surrounding the mating portion and a second shielding engaging with the mounting portion.

The second shielding is electrical connected with the first shielding and has an elongated shielding plate attached to a front surface of the mounting portion and a pair of holding legs extending from two ends of the shielding plates, the holding legs respectively attaching to two side surfaces of the mounting portion and extending downwardly to plug in the PCB. By this structure, the Electro Magnetic Interference (EMI) shielding is complete.

Other objects, advantages and novel features of the invention will become more apparent from the following detailed description when taken in conjunction with the accompanying drawings.

DETAILED DESCRIPTION OF THE INVENTION

Reference will now be made in detail to a preferred embodiment of the present invention.

Figure 1:
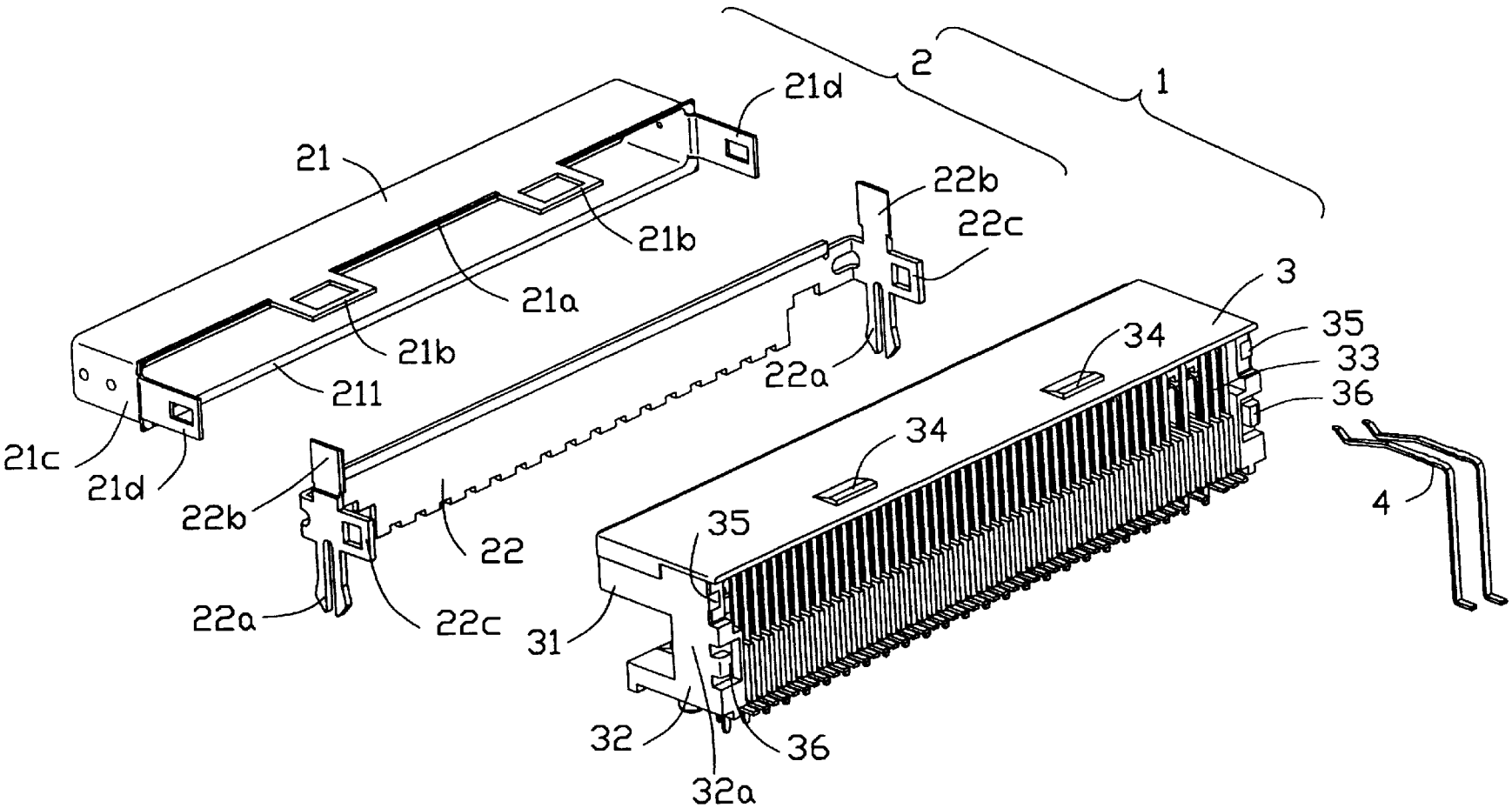
FIG. 1 is an exploded view of an electrical connector according to the present invention.
Figure 3:
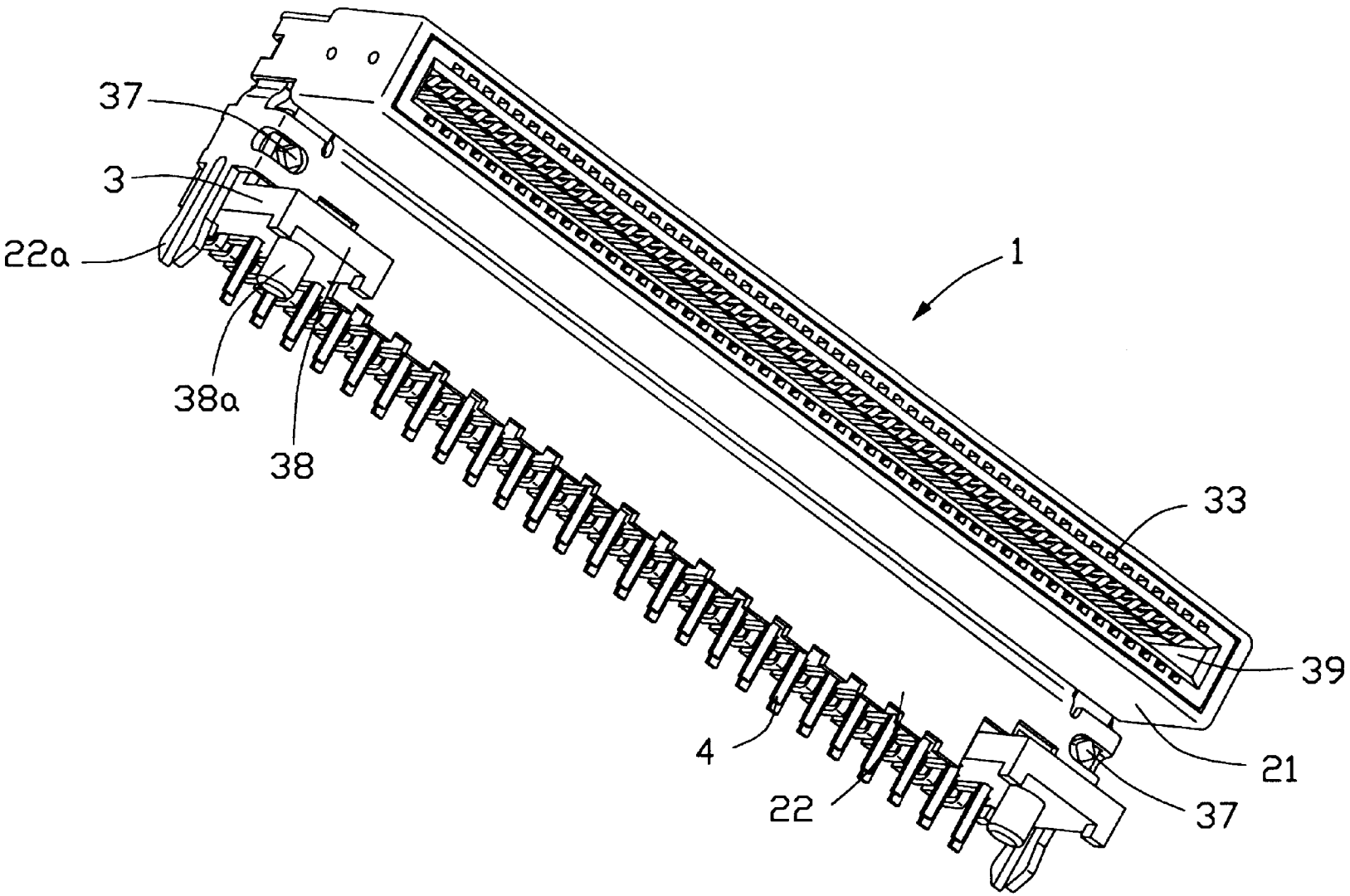
FIG. 3 is an assembled view of the electrical connector of FIG. 1.

Referring to the drawings and particularly to FIGS. 1 and 3, an electrical connector 1 in accordance with the present invention comprises an elongated dielectric housing 3, a plurality of terminals 4, and an elongated conductive shell 2 having a first shielding 21 and a second shielding 22.

The dielectric housing 3 comprises a horizontal mating portion 31 for mating with an electronic device (not shown) and a vertical mounting portion 32 for mounting to a printed circuit board (PCB) (not shown). A cavity 39 is defined through the mating portion 31 and is opening forwardly. A plurality of passageways 33 is defined in the cavity and a rear surface of the mounting portion 32. A pair of top barbs 34 protrudes on a top surface of the mating portion 31. A pair of first holding blocks 35 respectively protrudes rearwardly from two side walls 32*a* of the mounting portion 32. A pair of second holding blocks 36 respectively protrudes rearwardly from the two side walls 32*a* below the pair of first holding blocks 35. A pair of third holding blocks 37 respectively protrudes forwardly from the two side walls 32*a* opposite to the pair of second holding blocks 36. A pair of mounting plates 38 extends forwardly and horizontally from a bottom of the mounting portion 32. A post 38*a* protrudes downwardly from each mounting plate 38.

The metallic first shielding 21 comprises a pair of horizontal plates 21*a* and a pair of vertical plates 21*c* to form a substantial rectangular frame. Two first tabs 21*d* respectively extend rearwardly from the two vertical plates 21*c*, with a first hole (not labeled) defined in each first tab 21*d*. A pair of second tabs 21*b* extends rearwardly from the upper horizontal plate 21*a*, with a second hole (not labeled) defined in each second tab 21*a*.

Figure 2:
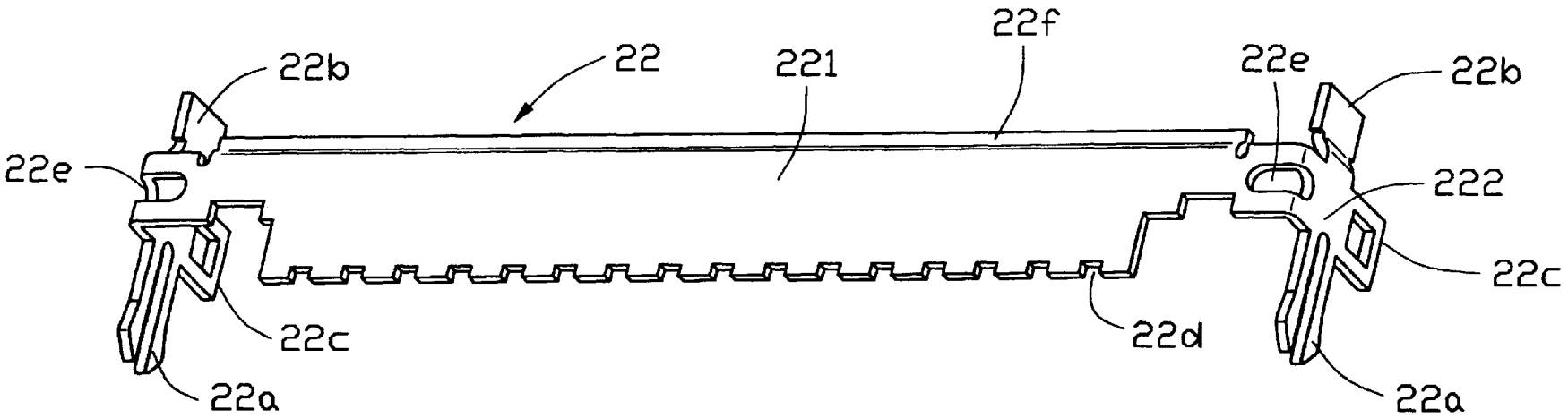
FIG. 2 shows a second shielding of the electrical connector of FIG. 1

Particularly referring to FIG. 2, the second shielding 22 is formed by a one-piece sheet metal and comprises an elongated vertical shielding plate 221 and a pair of side plates 222 extending and bending rearwardly from two ends of the shielding plate 221. A pair of holding legs 22*a* extends downwardly from a lower edge of each side plate 222. A locking protrusion (not labeled) protrudes at a low portion of each holding leg 22*a*. A third tab 22*c* extends rearwardly from a rear edge of each side plate 222 and has a third hole (not labeled). Two shielding pads 22*b* extend upwardly from the side plates 222. An upper edge 22*f* of the shielding plate 221 is bent inwardly. A plurality of notches 22*d* is defined in a lower edge of the shielding plate 221. A pair of fourth holes 22*e* are respectively defined in joints between the shielding plate 221 and the pair of side plates 222.

Particularly referring to FIG. 3, in assembly, the plurality of terminals 4 are received in corresponding passageways 33 with respective tail portions (not labeled) extending downwardly out of the housing 3 to solder with the PCB.

The second shielding 22 engages with the mounting portion 32 by attaching the shielding plate 221 to a front surface of the mounting portion 32 and by attaching the side plates 22*c* and the shielding pads 22*b* to outer surfaces of the side walls 32*a*. The third tabs 22*c* are bent to hold on the rear surface of the mounting portion 32 by the third holes of the third tabs 22*c* engaging with the second holding blocks 36.

The fourth holes 22*e* engage with the third holding blocks 37. The locking portions of the holding legs 22*a* extend downwardly to be lower than the bottom of the mounting portion 32.

The first shielding 21 engages around the mating portion 31, with an inner surface of the first shielding 21 abutting against an outer surface of the mating portion 31. The second tabs 21*b* are held on the top surface of the mating portion 31 by engaging the second holes of the second tabs 21*b* with the top barbs 34. The first tabs 21*d* attach with outer surfaces of the shielding pads 22*b* and are bent to hold on the rear surface of the mounting portion 32 by engaging the first holes of the first tabs 21*c* with the first holding blocks 35. The upper edge 22*f* of the second shielding 22 abuts against a rear edge 211 of the lower horizontal plate 21*a* to prevent a gap between the first shielding 21 and second shielding 22.

By such arrangement disclosed above, the shell 2 and the housing 3 are assembled firmly, and a complete and reliable Electro Magnetic Interference (EMI) shielding is obtained in this design. In use, when the electrical connector is mounted to the PCB, the holding legs 22*a* and the posts 38*a* are plugged in the PCB, and the mounting plates 38 attach with the PCB to stabilize the mounting. The holding legs 22*a* can be connected to a grounded circuit trace on the PCB to further improve the EMI shielding of the shell 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a PCB comprising:

an elongated dielectric housing including a vertical mounting portion and a horizontal mating portion with a cavity on a top portion of the mounting portion;

a plurality of terminals each with a contact portion extending into the mating portion and a tail portion extending along the mounting portion;

a first metal shield defining a circumferential wall with locking tabs extending rearwardly from the circumferential wall and latchably engaged with the housing, the first metal shield also enclosing the mating portion except the cavity; and a second metal shield defining an shielding plate with a similar longitudinal dimension with the circumferential wall and covering a front face of the mounting portion, the second metal shield further having a pair of side plates extending and bending rearwardly from two ends of the shielding plate, a pair of holding legs extending downwardly from a lower edge of each side plate, wherein the pair of holding legs respectively attaching to two side surfaces of the mounting portion, the second metal shield also having an upper edge that bending slightly and abutting against a rear edge of the first metal shield, a pair of holes are respectively defining in joint between the elongated plate and the pair of side plates, wherein the pair of holes are engaging with a pair of holding blocks protruding on the front surface of the mounting portion, and a pair of shielding pads respectively extending upwardly from the pair of the side plates and sandwiching between the corresponding locking tabs of the first metal shield and the housing.

2. The electrical connector as claimed in claim 1, wherein the shielding plate and the holding legs are formed by a one-piece sheet metal.

3. The electrical connector as claimed in claim 1, wherein the shielding plate includes a plurality of notches in a lower edge thereof.

4. The electrical connector as claimed in claim 1, wherein the first shielding includes a pair of tabs extending rearwardly from the rear edge thereof, the tabs attaching with outer surfaces of the shielding pads and bending to hold on a rear surface of the mounting portion.

* * * * *